US007696678B2

(12) United States Patent
Park et al.

(10) Patent No.: US 7,696,678 B2
(45) Date of Patent: Apr. 13, 2010

(54) PLASMA DISPLAY APPARATUS USING FILTER

(75) Inventors: Yu Park, Seoul (KR); Hun Gun Park, Gumi-si (KR)

(73) Assignee: LG Electronics Inc., Seoul (KR)

( * ) Notice: Subject to any disclaimer, the term of this patent is extended or adjusted under 35 U.S.C. 154(b) by 532 days.

(21) Appl. No.: 11/652,550

(22) Filed: Jan. 12, 2007

(65) Prior Publication Data

US 2008/0012793 A1 Jan. 17, 2008

(30) Foreign Application Priority Data

Jul. 12, 2006 (KR) ..... 10-2006-0065509

(51) Int. Cl.
*H01J 5/16* (2006.01)
*H01J 61/40* (2006.01)
*H01K 1/26* (2006.01)
*H01K 1/30* (2006.01)

(52) U.S. Cl. ..... 313/112; 313/582

(58) Field of Classification Search ..... 313/112, 313/113, 582–587
See application file for complete search history.

(56) References Cited

U.S. PATENT DOCUMENTS 6,657,387 B1 * 12/2003 Yoo ..... 313/587
7,271,955 B2 * 9/2007 Osawa et al. ..... 359/453
2006/0097650 A1 * 5/2006 Kim ..... 315/169.4
2006/0103768 A1 * 5/2006 Yee et al. ..... 349/5
2006/0145578 A1 * 7/2006 Park et al. ..... 313/112
2007/0059522 A1 * 3/2007 Choi et al. ..... 428/355 AC
2007/0120485 A1 * 5/2007 Kim ..... 313/582
2007/0132386 A1 * 6/2007 Kim et al. ..... 313/582

FOREIGN PATENT DOCUMENTS

EP 1 677 336 A2 7/2006
JP 2006-030844 A 2/2004
KR 10-0579713 B1 5/2006

OTHER PUBLICATIONS

European Search Report dated May 7, 2009.

* cited by examiner

*Primary Examiner*—Joseph L Williams
*Assistant Examiner*—Kevin Quarterman
(74) *Attorney, Agent, or Firm*—KED & Associates, LLP

(57) ABSTRACT

The present invention relates to a plasma display apparatus including an external light blocking sheet which blocks and absorbs the external light injected from the outside, in particular, in which a pattern portion having a predetermined gap and width on a base portion prevents the external light from injecting into the inside of a panel inside, in addition, and permits to efficiently radiate a light emitted from the inside of the panel, thereby, the bright room contrast of PDP can be improved.

17 Claims, 17 Drawing Sheets

PLASMA DISPLAY APPARATUS USING FILTER

BACKGROUND OF THE INVENTION

1. Field of the Invention

The present invention relates to a plasma display apparatus, in particular, to a plasma display apparatus capable of improving the bright room contrast of the panel and maintaining the brightness by installing a filter including an external light blocking sheet which blocks and absorbs the external light on the front side of the panel in order to prevent the light injected from the outside from being reflected in the panel.

2. Description of the Related Art

Plasma display panel (herein after, PDP) is an apparatus which generates a discharge by applying a predetermined voltage to the electrodes installed at the discharge space and displays an image including a characteristic and a graphic by exciting the phosphor with the plasma which is generated in the gaseous discharge, which facilitates the large-size, the light weight and the plane thin shape and provides the broad viewing angle in the up and down direction and in the left and right direction and has an advantage in that it can implement the full-color and the high brightness.

However, there is a problem in that, as to PDP, when a black image is implemented, the external light is reflected in the front side of panel of PDP due to the phosphor of white color which is exposed to the lower substrate of the panel, thereafter, the black image is recognized as a dark color of the bright color series, thereby the bright room contrast of PDP is degraded.

SUMMARY

Accordingly, the present invention has been made in view of the above problems occurring in the related art, and it is an object of the present invention to provide a plasma display apparatus including an external light blocking sheet which effectively blocks the external light which is injected to the plasma display panel to prevent the reflection of the light and innovatively improves the bright room contrast of the plasma display panel with the brightness of the panel.

A plasma display apparatus according to an aspect of the invention comprises a plasma display panel; and a filter formed on the front of the panel, wherein the filter includes a base portion and an external light blocking sheet in which a plurality of pattern portion which is formed in the base portion, wherein a first gap between the adjacent pattern portions formed in a first region of the external light blocking sheet is different from a second gap between the adjacent pattern portions formed in a second region of the external light blocking sheet.

According to an aspect of the invention, it is preferable that the first gap or the second gap is a gap from the end of the pattern portion to the end of the adjacent pattern portion.

The first or the second gap is a gap from the center of the pattern portion to the center of the adjacent pattern portion.

The width of the pattern portion formed in the first region is different from the width of the pattern portion formed in the second region. The width of the pattern portion formed in the first region is larger than the width of the pattern portion formed in the second region.

Preferably, the width of the pattern portion formed in the first region is 1.5 times to 4 times of the width of the pattern portion formed in the second region.

Preferably, the first gap is smaller than the second gap. while The first gap is 0.70 times to 0.99 times of the second gap.

The first region is arranged in the area positioned at a center when the front of the external light blocking sheet is divided into three parts; and the second region is arranged in the area positioned at an edge when the front of the external light blocking sheet is divided into three parts.

According to an aspect of the invention further comprises at least one of an AR layer preventing the reflection of the external light; a NIR shielding layer blocking a near infrared ray radiated from the panel; and an EMI shielding layer blocking a electromagnetic wave.

According to an aspect of the invention, in the cross-sectional shape of the pattern portion, the width of a lower part is wider than the width of the upper part, wherein the lower part of the pattern portion is arranged into the panel side while the upper part of the pattern portion is arranged into the side to which the external light is injected.

Preferably, the first region is arranged in the area positioned at a thickness of the external light blocking sheet ranges from 1.01 times to 2.25 times of the height of the pattern portion.

Preferably, the first region is arranged in the area positioned at a thickness of the external light blocking sheet ranges from 1.01 times to 2.25 times of the height of the pattern portion.

The index of refraction of the pattern portion is smaller than the index of refraction of the base portion.

A plasma display apparatus according to another aspect of the invention comprises a plasma display panel; and a filter formed on the front of the panel, wherein the filter includes a base portion and an external light blocking sheet in which a plurality of pattern portion which is formed in the base portion, wherein the width of the pattern portion formed in a first region of the external light blocking sheet is different from the width of the pattern portion formed in a second region of the external light blocking sheet.

Preferably, the thickness of the external light blocking sheet ranges from 1.01 times to 2.25 times of the height of the pattern portion.

In a plasma display apparatus according to another aspect of the invention, it is preferable that a gap from the center of the pattern portion formed in the first region to the center of the adjacent pattern portion is substantially identical with a gap from the center of the pattern portion formed in the second region to the center of the adjacent pattern portion.

Preferably, the width of the pattern portion formed in the first region is 1.5 times to 4 times of the width of the pattern portion formed in the second region.

The first region is arranged in the area positioned at a center when the front of the external light blocking sheet is divided into three parts; and the second region is arranged in the area positioned at an edge when the front of the external light blocking sheet is divided into three parts.

A plasma display apparatus according to another aspect of the invention further comprises at least one of an AR layer preventing the reflection of the external light; a NIR shielding layer blocking a near infrared ray radiated from the panel; and an EMI shielding layer blocking an electromagnetic wave.

BRIEF DESCRIPTION OF THE DRAWINGS

The invention will be described in detail with reference to the following drawings in which like numerals refer to like elements. The accompany drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENT

Preferred embodiments of the present invention will be described in a more detailed manner with reference to the drawings.

Figure 1:
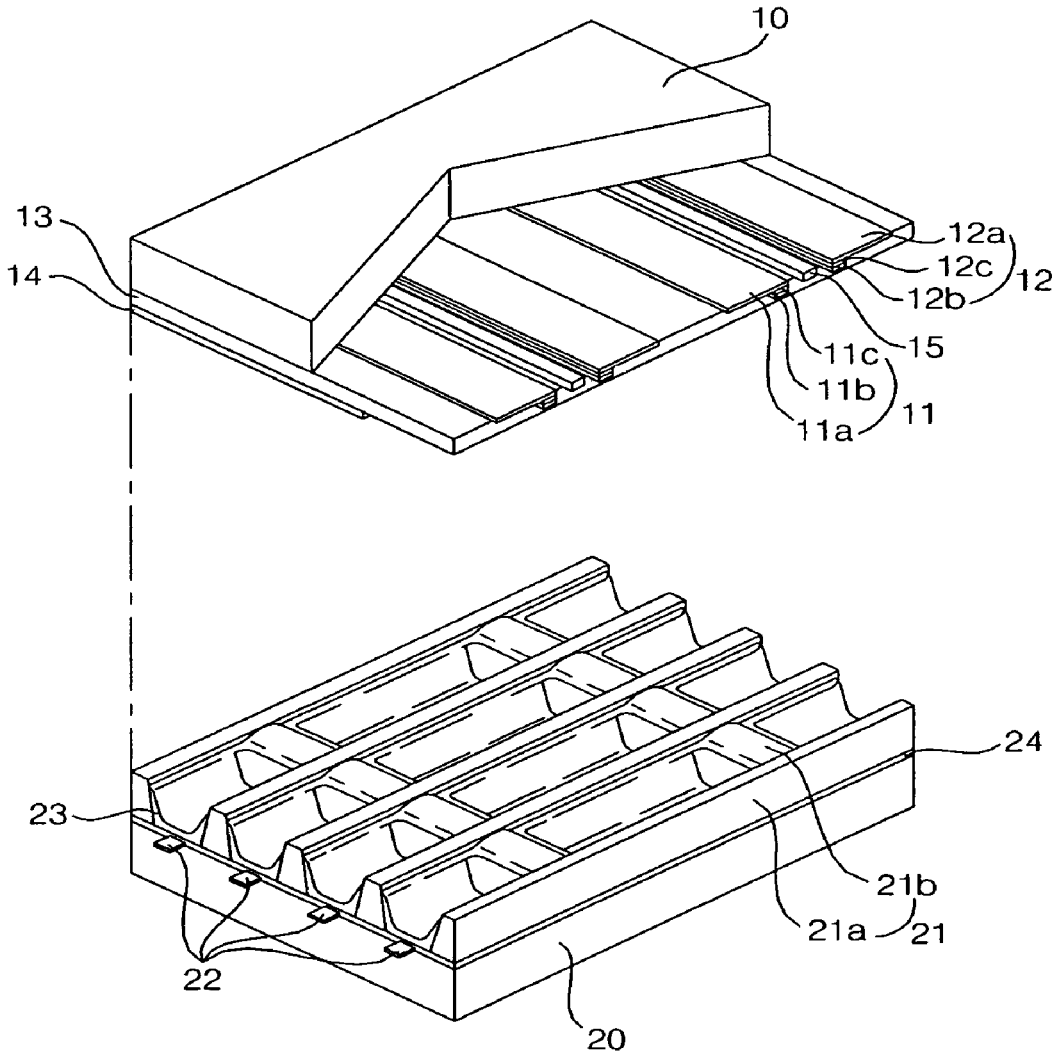
FIG. 1 is a perspective view which shows an embodiment of a plasma display panel configuration.

FIG. 1 is a perspective view which shows an embodiment of a plasma display panel configuration.

Referring to FIG. 1, the plasma display panel includes a scan electrode 11 and a sustain electrode 12 which are a sustain electrode pair formed on the upper substrate 10, and an address electrode 22 formed on the lower substrate 20.

Generally, the sustain electrode pair 11, 12 is comprised of a transparent electrode 11*a*, 12*a* made of Indium-Tin-Oxide ITO and a bus electrode 11*b*, 12*b* which can be formed of the metal including the silver Ag and the chrome Cr or the stack of the chrome/copper/chrome Cr/Cu/Cr or the stack of the chrome/aluminum/chrome Cr/Al/Cr. At this time, bus electrode 11*b*, 12*b* is formed on the transparent electrode 11*a*, 12*a* to reduce the voltage drop by the transparent electrode 11*a*, 12*a* having a high resistance.

In the meantime, according to the embodiment of the invention, the sustain electrode pair 11, 12 can be comprised of bus electrode 11*b*, 12*b* without transparent electrode 11*a*, 12*a* as well as the structure in which the transparent electrode 11*a*, 12*a* and the bus electrode 11*b*, 12*b* are laminated. Such structure does not use the transparent electrodes 11*a*, 12*a*. Therefore, the unit cost in the panel manufacturing can be reduced. As to the bus electrode 11*b*, 12*b* used for such structure, various materials including the photoresist material can be used except the material described in the above.

Further, a Black Matrix BM is formed in PDP, which performs the function of the light blocking which absorbs the light generated in the outside of the upper substrate 10 to reduce a reflection and performs the function of improving the purity of the upper substrate 10 and the contrast of PDP.

The black matrix 15 according to the embodiment of the invention is formed on the upper substrate 10, being comprised of a first black matrix 15 is formed in the position overlapped with the barrier rib 21 and a second black matrix 11*c*, 12*c* formed between the transparent electrodes 11*a*, 12*a* and the bus electrode 11*b*, 12*b*. Here, the first black matrix 15 and the second black matrix 11*c*, 12*c* which is called as the black layer or the black electrode layer can be simultaneously formed in the forming process thereby it can be physically connected, while it is not physically connected when they are not simultaneously formed.

Furthermore, in case it is formed by being physically connected, the first black matrix 15 and the second black matrix 11*c*, 12*c* are formed with the same material. However, in case it is formed by being physically separated, the first black matrix 15 and second black matrix 11*c*, 12*c* can be formed with other material.

In the upper substrate 10 in which the scan electrode 11 and the sustain electrode 12 are formed, an upper dielectric layer 13 and a protective layer 14 are laminated. In the upper dielectric layer 13, charged particles generated by a discharge are accumulated to perform the function of protecting sustain electrode pair 11, 12. The protective layer 14 protects the upper dielectric layer 13 from the sputtering of the charged particles generated in the gaseous discharge, enhancing the emission efficiency of the secondary electron.

In the meantime, the address electrode 22 is formed in the direction intersecting with the scan electrode 11 and the sustain electrode 12. In the lower substrate 20 in which the address electrode 22 is formed, the lower dielectric layer 24 and the barrier rib 21 are formed.

On the surface of the barrier rib 21 and the lower dielectric layer 24, the phosphor 23, stimulated by the ultraviolet ray generated in the gaseous discharge, generating the visible light, is coated.

The barrier rib 21 is comprised of a column barrier rib 21*a* developed into the direction in parallel with the address electrode 22 and a row barrier rib 21*b* developed into the direction intersecting with the address electrode 22, which physically divides the discharge cell and prevents the ultraviolet ray and the visible light generated by a discharge from being leaked out to the adjacent discharge cell.

In the embodiment of the invention, the structure having various shape of the barrier rib 21 as well as the structure of the barrier rib 21 shown in FIG. 1 can be used. For example, a differential type barrier rib structure where the height of the column barrier rib 21*a* and the row barrier rib 21*b* is different, a channel type barrier rib structure where a channel which can be used as a ventilating passage is formed in at least one of the column barrier rib 21*a* and the row barrier rib 21*b*, and a groove type barrier rib structure where hollows are built up in at least one of the column barrier rib 21*a* and the row barrier rib 21*b* can be used.

Here, in case of the differential barrier rib structure, it is preferable that the height of the row barrier rib 21*b* is higher than the column barrier rib 21*a*, while, in case of the channel type barrier rib structure or the groove type barrier rib structure, it is preferable that a channel or a hollow is formed in the row barrier rib 21*b*.

In the meantime, in the embodiment of the invention, it is illustrated that R, G and B discharge cells are arranged in the identical line. However, other arrangement can be used. For example, the arrangement of the delta type where R, G, and B discharge cells are arranged in a triangle form can be used. Further, as to the shape of the discharge cell, various polygonal shapes including the pentagon, the hexagon as well as the square shape can be used.

Figure 2:
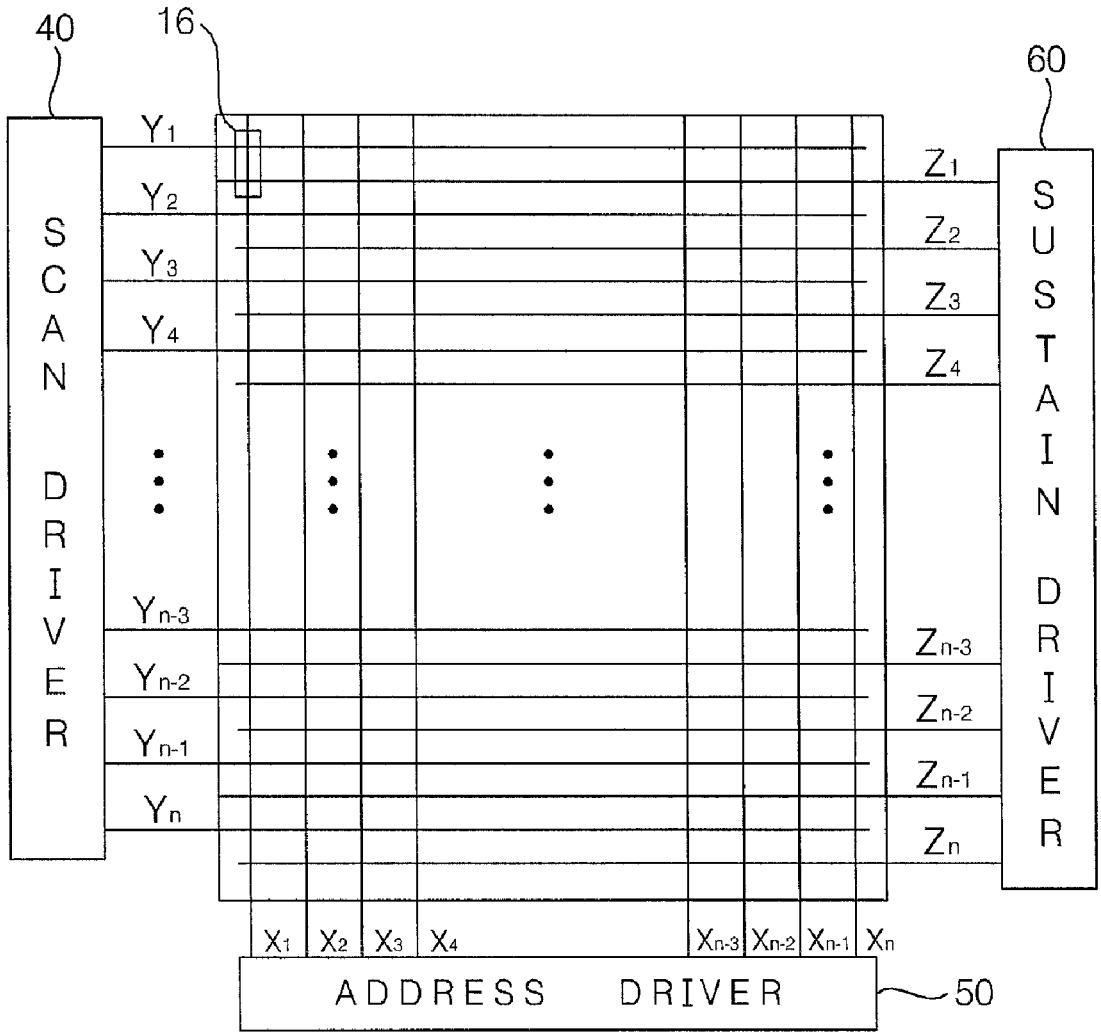
FIG. 2 is a drawing which shows an embodiment of the electrode arrangement of a plasma display panel.

FIG. 2 is a drawing which shows an embodiment of the electrode arrangement of a plasma display panel.

Referring to FIG. 2, it is preferable that, as shown in FIG. 2, a plurality of discharge cells forming a plasma display panel are arranged as a matrix type. A plurality of discharge cells 15 are positioned in the intersection of the scan electrodes Y1 to Yn, the sustain electrodes Z1 to Zn, and the address electrodes X1 to Xn.

Furthermore, a plurality of scan electrodes Y1 to Yn are sequentially driven by a scan driver 40. A plurality of sustain electrodes Z1 to Zn are applied with the sustain signal which is provided from the sustain driver 60 to be commonly driven. Additionally, a plurality of address electrodes X1 to Xn are provided with data signal which is synchronized with the scan signal from the address driver 50.

In the meantime, since the electrode arrangement and the driving method shown in FIG. 2 is just an exemplary embodiment of the plasma display panel according to the invention, the invention is not restricted in the electrode arrangement and the driving method of the plasma display panel shown in FIG. 2. For example, the dual scan method dividing the scan electrodes Y1 to Yn into a first scan electrode group and a second scan electrode group to sequentially apply the driving signal can be used. Furthermore, in the center area of the panel, the address electrodes X1 to Xn can be divided into an upper portion and an lower portion to be driven.

Figure 3:
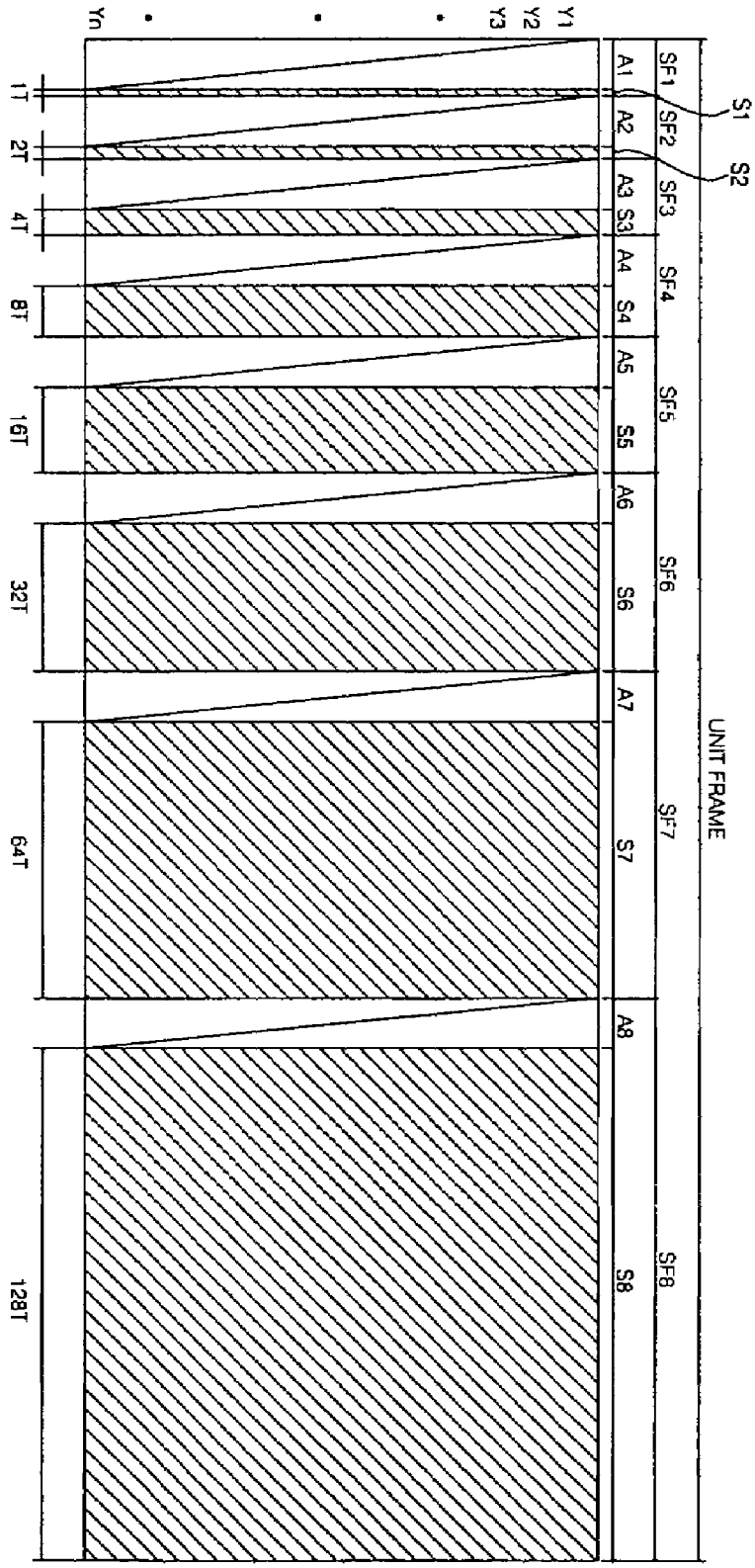
FIG. 3 is a drawing which shows an embodiment of the method by which the frame of an image is time-divided into a plurality of subfields in a plasma display apparatus.

FIG. 3 is a drawing which shows an embodiment of the method by which the frame of an image is time-divided into a plurality of subfields in a plasma display apparatus.

Referring to FIG. 3, the unit frame can be time-divided driven into a predetermined number, for example, 8 subfields SF1, . . . , SF8 in order to express the gray scale of an image. Further, each subfield SF1, . . . , SF8 is divided into a reset period (not shown) and an address period A1, . . . , A8 and a sustain period S1, . . . , S8.

In each address period A1, . . . , A8, the data signal is applied to the address electrode X, while the scan pulse corresponding to it is sequentially applied to the scan electrode Y.

In each sustain period S1, . . . , S8, the sustain pulse is alternately applied to the scan electrode Y and the sustain electrode Z so that the sustain discharge is generated in the discharge cells selected in the address period A1, . . . , A8.

The luminance of a plasma display panel is in proportion to the number of the sustain discharge in the sustain period S1, . . . , S8 of the unit frame. In case one frame forming an image is expressed with eight subfields and 256 gray scales, sustain pulses having different number can be allocated to each subfield in the rate of 1, 2, 4, 8, 16, 32, 64, 128. On the other hand, in order to obtain the luminance of 133 gray scale, the sustain discharge is generated by addressing cells during subfield 1 section, subfield 3 section and subfield 8 section.

In the meantime, the number of sustain discharge allocated to each subfield can be variably determined depending on the weighted value of the subfields. That is, in FIG. 3, it is illustrated that one frame is divided into eight subfields, however, the invention is not restricted in such case, but the number of subfields forming a frame can be variously changed according to the design type. For example, one frame can be divided into over eight subfields or below eight subfields such as twelve subfields or sixteen subfields to drive the plasma display panel.

Further, the number of sustain discharge allocated to each subfield can be variously changed in consideration of the gamma characteristics or the panel characteristics. For example, the gray level allocated to subfield four can be lowered to six, while the gray level allocated to subfield six can be enhanced from thirty two to thirty four.

Figure 4:
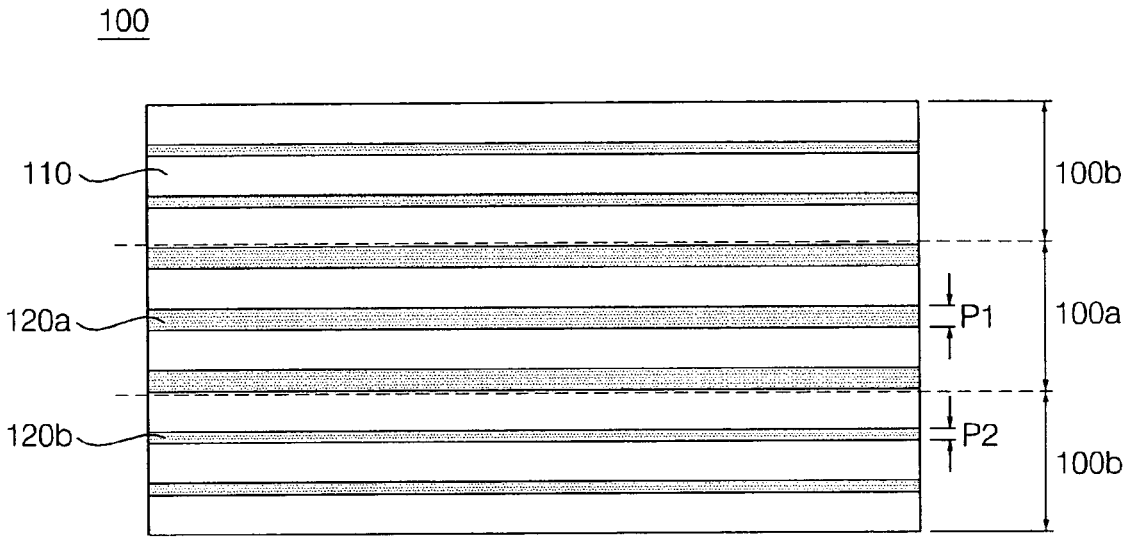
FIG. 4 is a drawing which shows a first embodiment of the configuration of an external light block sheet according to the invention.

FIG. 4 is a drawing which shows a first embodiment of the configuration of an external light block sheet according to the invention.

Referring to FIG. 4, the external light blocking sheet 100 of the invention is comprised of a base portion 110 and a plurality of pattern portions 120*a*, 120*b* formed in the base portion 110 in series. It is preferable that the thickness of the external light blocking sheet 100 ranges from 20 μm to 250 μm in consideration of the height of the pattern portions 120*a*, 120*b* and the transmittance ratio of the light.

The base portion 110 is formed with a transparent plastic material having a predetermined refractive index. For example, it is most desirable to use a resin formed with ultraviolet ray UV hardening mode, however, if the material is transparent and can be thin shaped like glass, it can be used.

Pattern portion 120*a*, 120*b* are formed between the base portions 110 with a predetermined gap. At this time, pattern portion 120*a*, 120*b* has a predetermined gap with the other adjacent pattern portions 120*a*, 120*b*. That is, pattern portions 120*a*, 120*b* which are adjacent each other can be formed with a uniform gap in consideration of the simplicity of the manufacturing process. However, in order to make the luminance of the entire screen uniform, it is preferable that the gap of the adjacent pattern portion is formed to be relatively broad in the region where the luminance is decreased in a screen.

Accordingly, the external light blocking sheet 100 adhered to the front of the panel is divided into three parts up and down, being classified into an edge area 100*b* which is the edge of the upside and the bottom side and a central area 100*a* located in the center of the screen. At this time, it is preferable that the width P1 of the pattern portion 120*a* formed in the central area 100*a* of the external light blocking sheet 100 and the width P2 of the pattern portion 120*b* formed in the edge area 100*b* are different. At this time, the gap between the pattern portions 120*a*, 120*b* which are adjacent each other is substantially identically formed. In that case, the pattern portion 120*a* having small width is formed in the central area of the screen where the luminance is relatively high, while the pattern portion 120*b* having large width is formed in the edge area of the screen where the luminance is relatively low so that the luminance of the entire screen becomes uniform. Accordingly, the bright room contrast as well as the image quality is improved. At this time, the width P1, P2 of the pattern portion 120*a*, 120 is substantially identical with the bottom portion which is greater than the upper portion of the pattern portion.

Figure 5A:
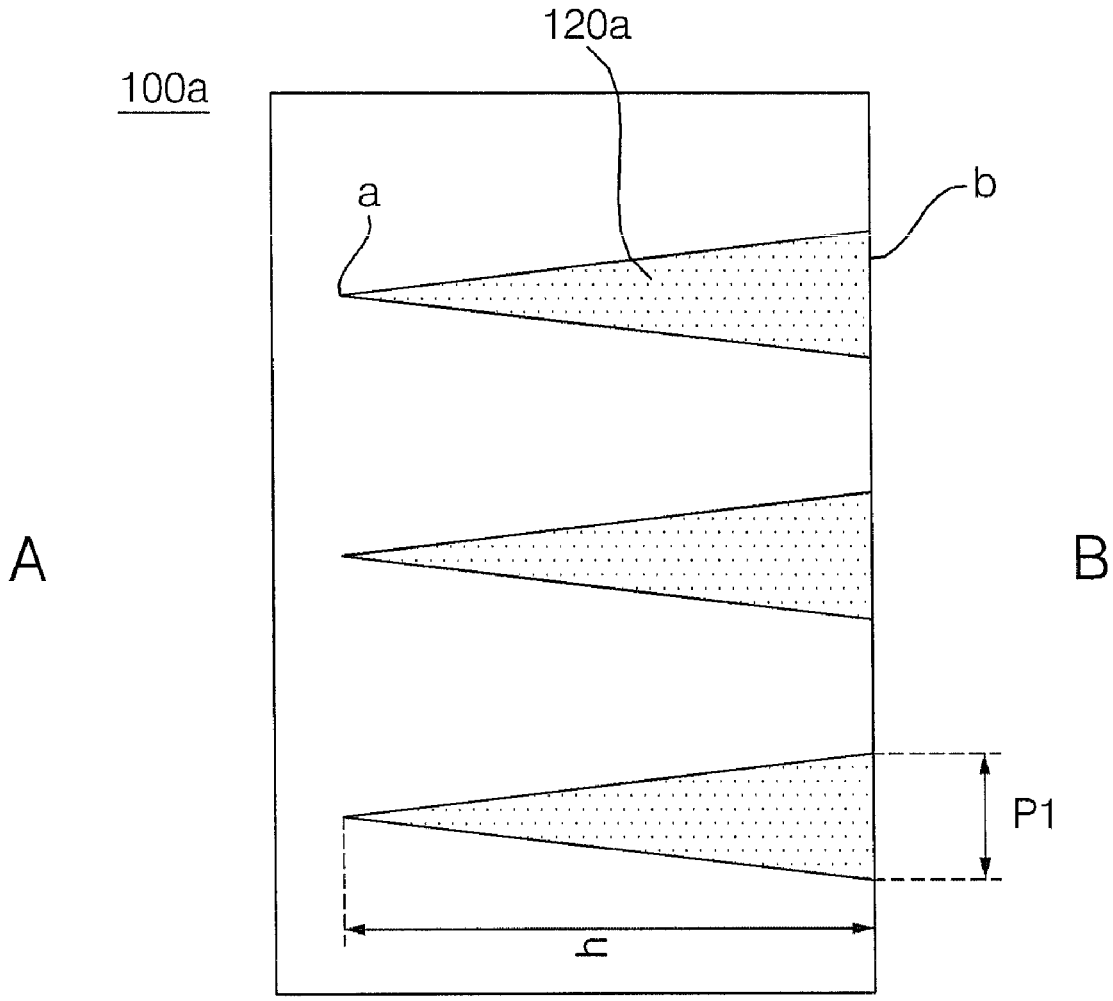
FIG. 5*a* to FIG. 5*b* shows the section structure of a first embodiment of the external light block sheet according to the invention.
Figure 5B:
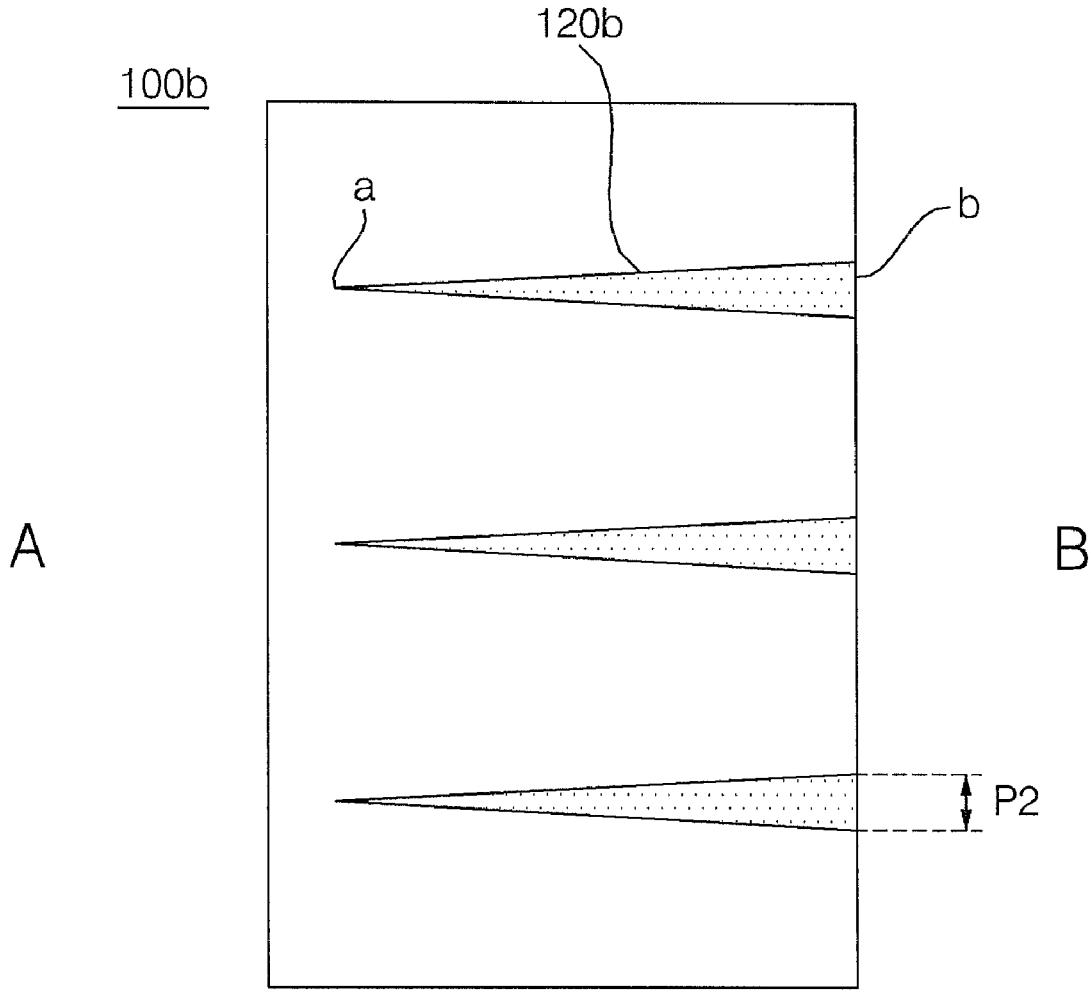

FIG. 5*a* to FIG. 5*b* shows the section structure of a first embodiment of the external light block sheet according to the invention.

Referring to FIG. 5*a* to FIG. 5*b*, in the central area 100*a* of the external light blocking sheet 100, the pattern portion 120*a* is formed with a first width P1, while the pattern portion 120*b* is formed in the edge area 100*b* of the external light blocking sheet 100 having a second width P2.

At this time, it is preferable that the first width P1 of pattern portion 120*a*, 120*b* ranges from 1.5 times to 4 times of the second width P2. In that case, the luminance factor of the central area 10*a* and the edge area 100*b* where the luminance factor is relatively low gets to be uniform in the entire screen.

In the meantime, in the first embodiment of the invention, it is illustrated that the width of pattern portions 120*a*, 120*b* which are respectively formed in the central area 100*a* and the edge area 100*b* of the external light blocking sheet 100 is identical. However, the width of the pattern portion 120*a* may be more reduced from the central area 100*a* to the edge area 100*b*. At least one width among a plurality of pattern portion can be differently formed in each central area 100*a* and edge area 100*b* having the width of the different pattern portion.

It is preferable that, as to the filter including the external light blocking sheet 100, the upper portion of the pattern portion is located in the direction in which the external light is injected or in the user side A, while the bottom b of the pattern portion is located in the panel side B.

Further, the configuration of the external light blocking sheet will be described in detail. In case the thickness T of the external light blocking sheet ranges from 20 μm to 250 μm, the manufacturing process is facilitated and a proper light transmission rate can be obtained. The thickness T of the external light blocking sheet can be ranges from 100 μm to 180 μm in order to smoothly transmit the light emitted from the panel, in order to effectively absorb and block the light, which is injected from the outside and is refracted, to the pattern portion 120, and in order to obtain the robustness of the sheet.

Further, when the height h of the pattern portion equipped in the external light blocking sheet ranges from 80 μm to 170 μm, the manufacture of the pattern portion is most facilitated, the proper aperture ratio of the external light blocking sheet can be obtained, and the external light blocking effect and the reflection effect of the light which is emitted from the panel can be maximized.

The height h of such pattern portion can be varied according to the thickness T of the external light blocking sheet. It is preferable that the height h of the pattern portion has the value within a given ratio range for the thickness T of the external light blocking sheet in order to effectively block the external light which is injected to the panel since, in general, the external light which is injected to the panel to affect the bright room contrast decrease is mainly positioned in the upper portion than the position of the panel.

Referring to FIG. 5*a*, as the height h of the pattern portion increases, the base portion thickness of the upper part of the pattern portion is decreased to generate a breakdown. As the height h of the pattern portion is decreased, the external light which has the angle within a given range is injected to the panel, the external light blocking is not properly performed.

Table 1 shows the result of the experiment on the isolation break down of the external light blocking sheet and the external light blocking effect according to the thickness T of the external light blocking sheet and the height h of the pattern portion.

TABLE 1

| Thickness of sheet(T) | Height of pattern portion(H) | Break down | External light blocking |
|---|---|---|---|
| 120 μm | 120 μm | ○ | ○ |
| 120 μm | 115 μm | Δ | ○ |
| 120 μm | 110 μm | X | ○ |
| 120 μm | 105 μm | X | ○ |
| 120 μm | 100 μm | X | ○ |
| 120 μm | 95 μm | X | ○ |
| 120 μm | 90 μm | X | ○ |
| 120 μm | 85 μm | X | ○ |
| 120 μm | 80 μm | X | ○ |
| 120 μm | 75 μm | X | Δ |
| 120 μm | 70 μm | X | Δ |
| 120 μm | 65 μm | X | Δ |
| 120 μm | 60 μm | X | Δ |

TABLE 1-continued

| Thickness of sheet(T) | Height of pattern portion(H) | Break down | External light blocking |
|---|---|---|---|
| 120 μm | 55 μm | X | Δ |
| 120 μm | 50 μm | X | X |

Referring to Table 1, when the thickness T of the external light blocking sheet is 120 μm, in case the height h of the pattern portion is formed with 120 μm or more, the pattern portion may be in danger of breakdown so that the failure rate of a product can increase. If the height h of the pattern portion is formed with 115 μm or less, the pattern portion is not in danger of breakdown so that the failure rate of the external light blocking sheet can be decreased. However, when the height h of the pattern portion is formed with 75 μm or less, the efficiency with which the external light is blocked by the pattern portion can decrease, while the external light can be injected to the panel when the height h of the pattern portion is formed with 50 μm or less.

When the thickness T of the external light blocking sheet ranges from 1.01 times to 2.25 times of the height of the pattern portion, the breakdown of the upper part of the pattern portion can be prevented and the external light is prevented from being injected to the panel. Further, in order to increase the reflectivity of the light emitted from the panel and to obtain a sufficient viewing angle with preventing the breakdown and the injection of the external light to the panel, the thickness T of the external light blocking sheet ranges from 1.01 times to 1.5 times of the height of pattern portion.

Figure 6:
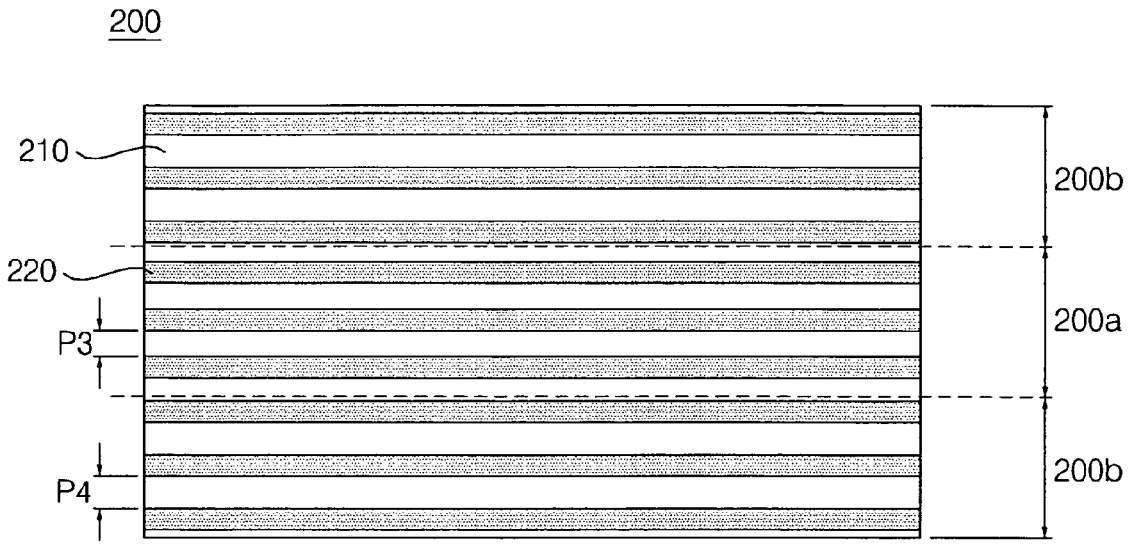
FIG. 6 is a drawing which shows a second embodiment of the configuration of an external light block sheet according to the invention.
Figure 7A:
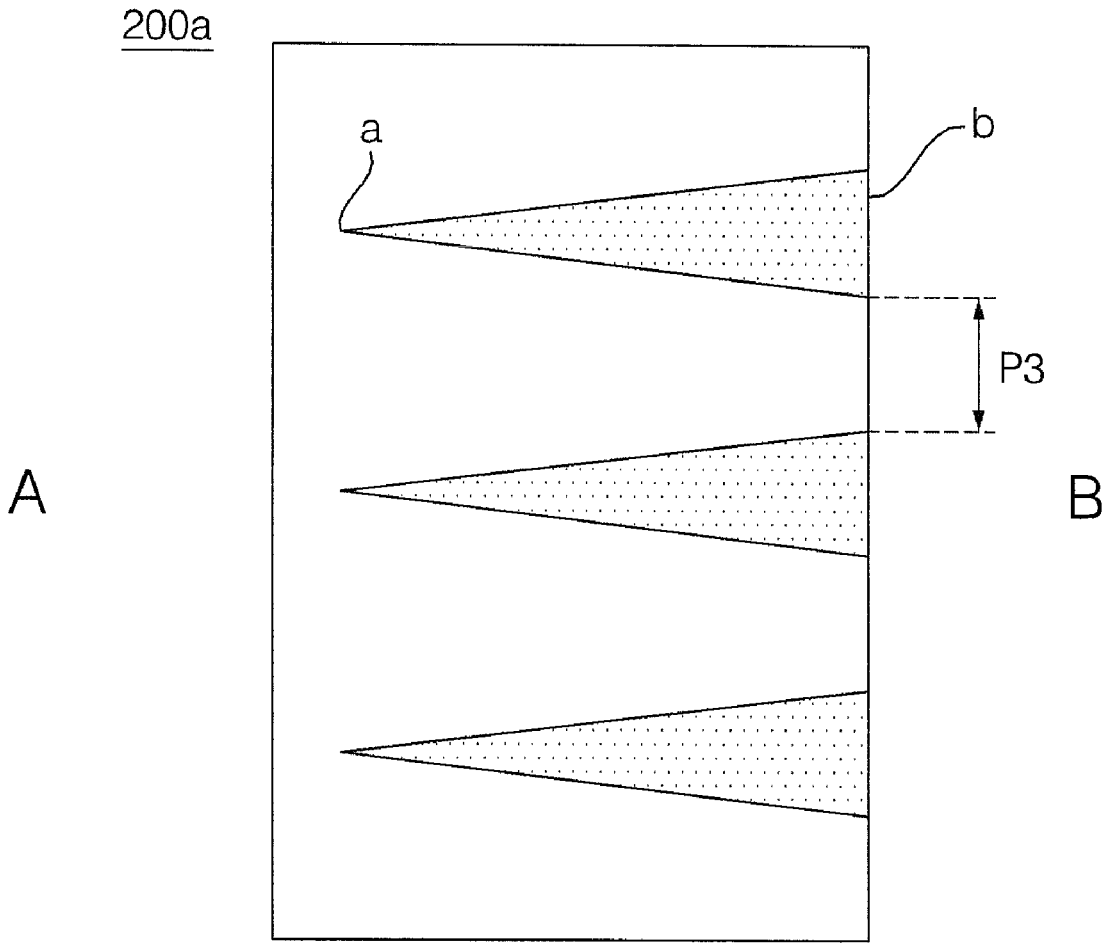
FIG. 7*a* to FIG. 7*b* shows the section structure of a second embodiment of the external light block sheet according to the invention.
Figure 7B:
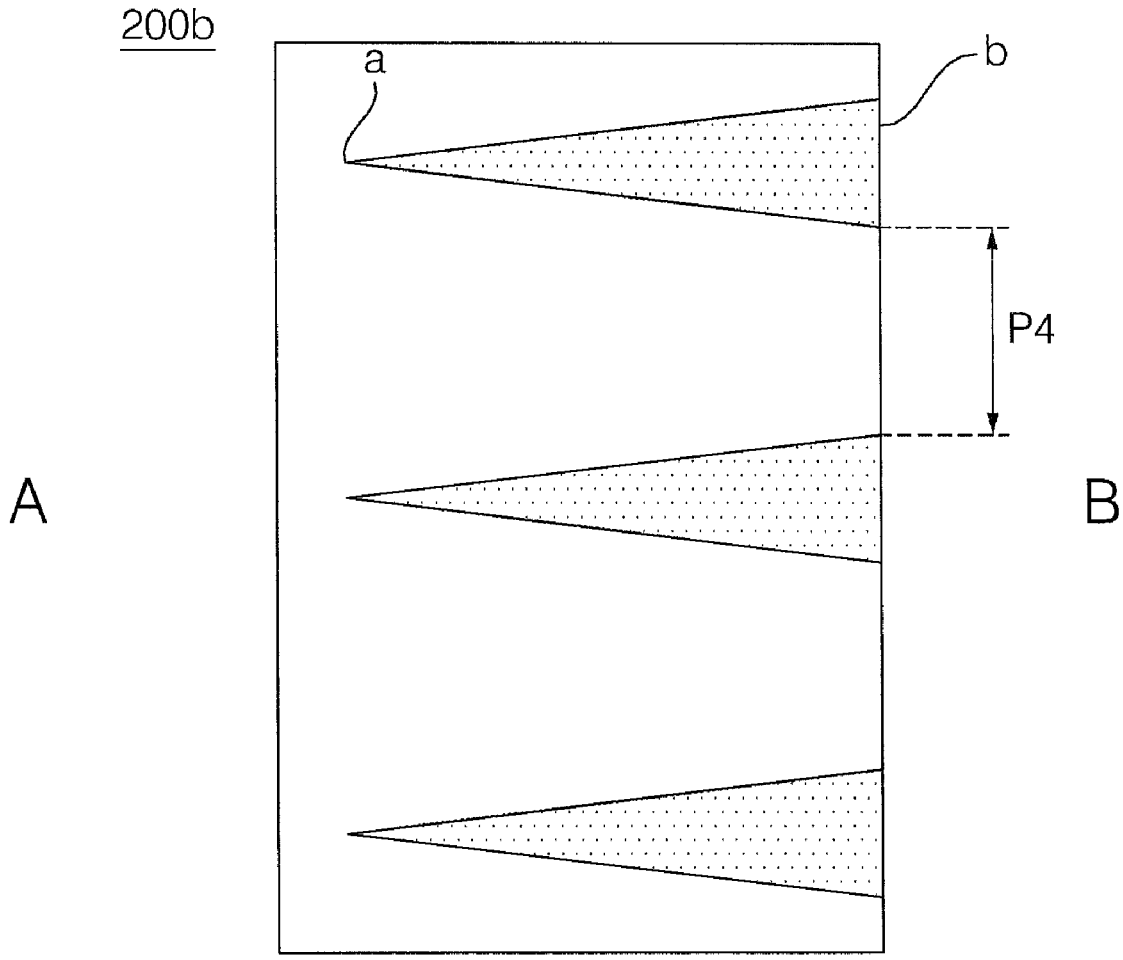

FIG. 6 is a drawing which shows a second embodiment of the configuration of an external light block sheet according to the invention, FIG. 7*a* to FIG. 7*b* shows the section structure of a second embodiment of the external light block sheet according to the invention. The same description which is illustrated with the drawing shown in FIG. 4 to FIG. 5*b* among the configuration of the external light blocking sheet shown in FIG. 6 to FIG. 7*b* will be omitted.

As shown in FIG. 6, the external light blocking sheet 200 according to the second embodiment of the invention is comprised of a base portion 210 and a pattern portion 220. As to the external light blocking sheet 200 according to the second embodiment of the invention, the gap of the adjacent pattern portions 220 which are respectively formed in the front central area 200*a* and the edge area 200*b* of the external light blocking sheet 200 is differently formed. The description will be illustrated with reference to FIG. 7*a* to FIG. 7*b*.

The central area 200*a* of the external light blocking sheet 200 has a first gap P3 between the adjacent pattern portions 220 while the adjacent pattern portions 220 have a second gap P4 in the edge area 200*b* of the external light blocking sheet 200. At this time, the width of pattern portions 220 which are formed in the central area 200*a* and the edge area 200*b* is substantially identical. Further, it is preferable that the first gap P3 of the adjacent pattern portions 220 is formed with 0.70 times to 0.99 times of the second gap P4. The gap P4 between the pattern portions 220 formed in the edge area 200*b* is made to be larger than the gap P3 between the pattern portions 220 formed in the central area 200*a* of the external light blocking sheet 200 so that the luminance of a screen can be uniform and the bright room contrast can be improved.

In the meantime, in the second embodiment of the invention, it was illustrated that the structure of the external light blocking sheet is divided into three parts with the central area and the edge area of the external light blocking sheet. However, the gap between the adjacent pattern portions increases or can be different from the center to the upper part or the lower part. In FIG. 6 to FIG. 7*b*, all the line width of the pattern portion are set to be identical, while the line width can be differently formed in at least one of a plurality of pattern portions.

Figure 8:
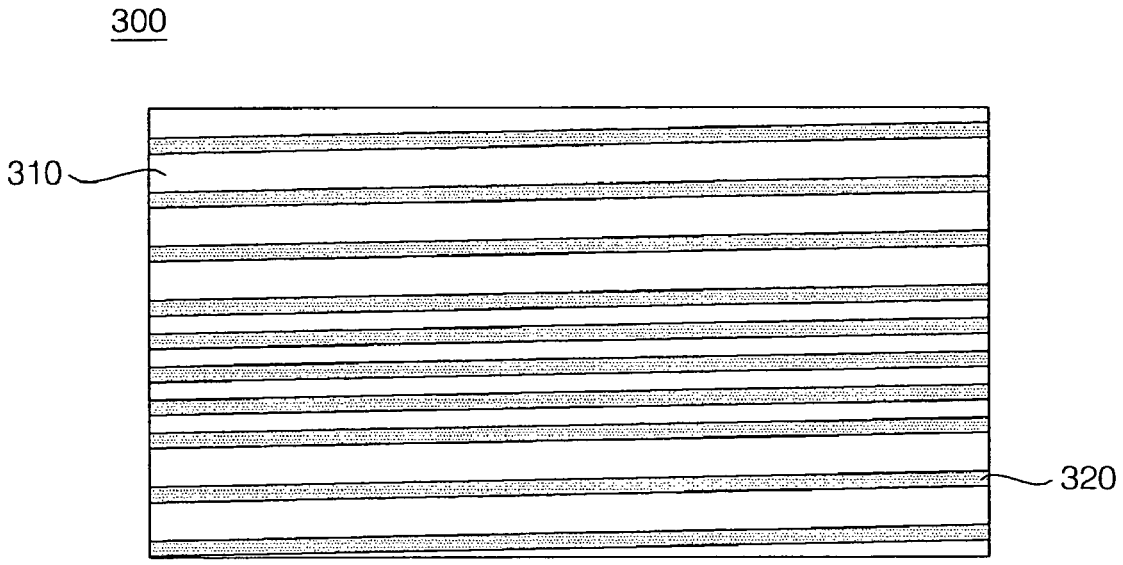
FIG. 8 is a drawing which shows an embodiment of the front configuration of an external light block sheet according to the invention.

FIG. 8 is a drawing which shows an embodiment of the configuration of an external light block sheet according to the invention.

Referring to FIG. 8, the external light blocking sheet 300 according to the invention includes a base portion 310 and a pattern portion 320. The gap between the pattern portions 320 formed in the central area 300*a* of the external light blocking sheet 300 is smaller than the gap between the pattern portions 320 formed in the edge area 300*b*, while the width of pattern portions 320 is substantially identical. Further, in order to prevent the Moiré phenomenon generated by the interference of the black matrix or the black layer, the bus electrode, the barrier rib and the pattern portion 320, the pattern portion 320 is formed with tilt degree 0.5 to 15 in the cross direction of the external light blocking sheet 300 based on the horizontal line.

In the meantime, in FIG. 8, the width of the pattern portion is the same and the gap between the pattern portions is differently formed, however, it is not restricted in that. Hence, the width of the pattern portion can be differently formed while the width of the pattern portion and the gap between the pattern portions which are adjacent each other can be differently formed at the same time.

Here, the Moire effect means the pattern of a low frequency which is generated by overlapping a similar grid pattern. For example, it is like a wave design pattern shown in a overlapped mosquito net. The Moire effect has a correlation with the width of the lower part of the pattern portion which is substantially identical with the width of the pattern portion, the width of the bus electrode formed in the inside of the panel and the width of the column barrier rib as well as the angle of the pattern portion measured from the upper part or the lower part of the external light blocking sheet.

Table 2 represents the result of an experiment on the Moire effect generation and the external light blocking effect according to the rate of the width of the lower part of the pattern portion of the external light blocking sheet and the bus electrode width formed in the upper substrate of the panel. In this case, the width of the bus electrode is 90 μm.

TABLE 2

| Width of lower part of pattern portion/width of bus electrode | Moire | External light blocking |
|---|---|---|
| 0.10 | ○ | X |
| 0.15 | Δ | X |
| 0.20 | X | Δ |
| 0.25 | X | ○ |
| 0.30 | X | ○ |
| 0.35 | X | ○ |
| 0.40 | X | ○ |
| 0.45 | Δ | ○ |
| 0.50 | Δ | ○ |
| 0.55 | ○ | ○ |
| 0.60 | ○ | ○ |

Referring to Table 2, when the width of the lower part of the pattern portion ranges from 0.2 times to 0.5 times of the width of the bus electrode, the Moire effect can be reduced and the external light can be reduced. Further, it is preferable the width of the lower part of the pattern portion ranges from 0.25 times to 0.4 times of the width of the bus electrode in order to prevent the Moire phenomenon, to effectively block the external light, and to secure the aperture ratio for the emission of the panel light.

Table 3 represents the result of an experiment on the Moire phenomenon generation and the external light blocking effect according to the rate of the width of the lower part of the pattern portion of the external light blocking sheet and the width of the column barrier rib formed in the lower substrate of the panel. In this case, the width of the column barrier rib is 50 μm.

TABLE 3

| Width of lower part of pattern portion/width of upper part of column barrier rib | Moire | External light blocking |
|---|---|---|
| 0.10 | ○ | X |
| 0.15 | Δ | X |
| 0.20 | Δ | X |
| 0.25 | Δ | X |
| 0.30 | X | Δ |
| 0.35 | X | Δ |
| 0.40 | X | ○ |
| 0.45 | X | ○ |
| 0.50 | X | ○ |
| 0.55 | X | ○ |
| 0.60 | X | ○ |
| 0.65 | X | ○ |
| 0.70 | Δ | ○ |
| 0.75 | Δ | ○ |
| 0.80 | Δ | ○ |
| 0.85 | ○ | ○ |
| 0.90 | ○ | ○ |

Referring to Table 3, when the width of the lower part of the pattern portion ranges from 0.3 times to 0.8 times of the width of the column barrier rib, the Moire effect can be reduced and the external light injected to the panel can be reduced. Further, it is preferable the width of the lower part of the pattern portion ranges from 0.4 times to 0.65 times of the width of the column barrier rib in order to prevent the Moire phenomenon, to effectively block the external light, and to secure the aperture ratio for the emission of the panel light.

Figure 9A:
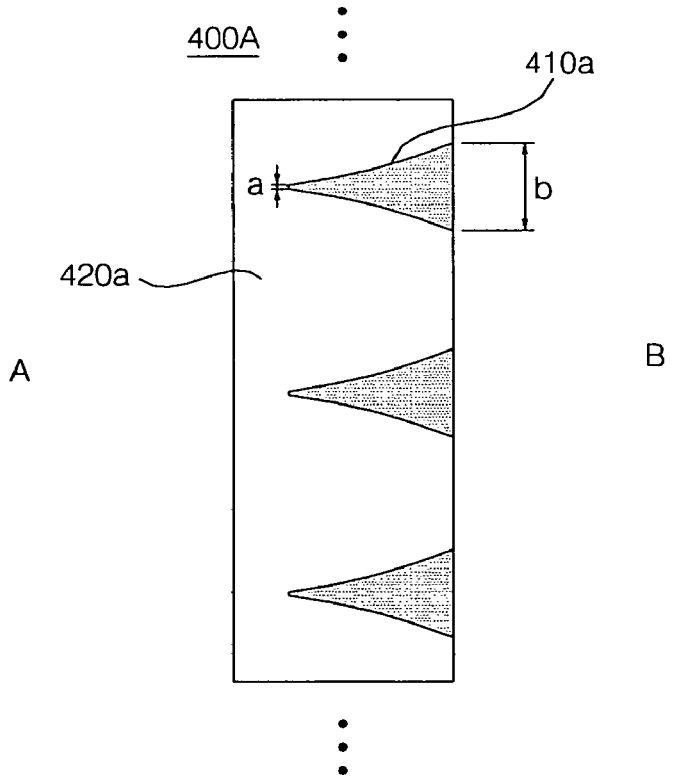
FIG. 9*a* to FIG. 9*c* shows embodiments of the pattern portion of the external light block sheet according to the invention.
Figure 9A:
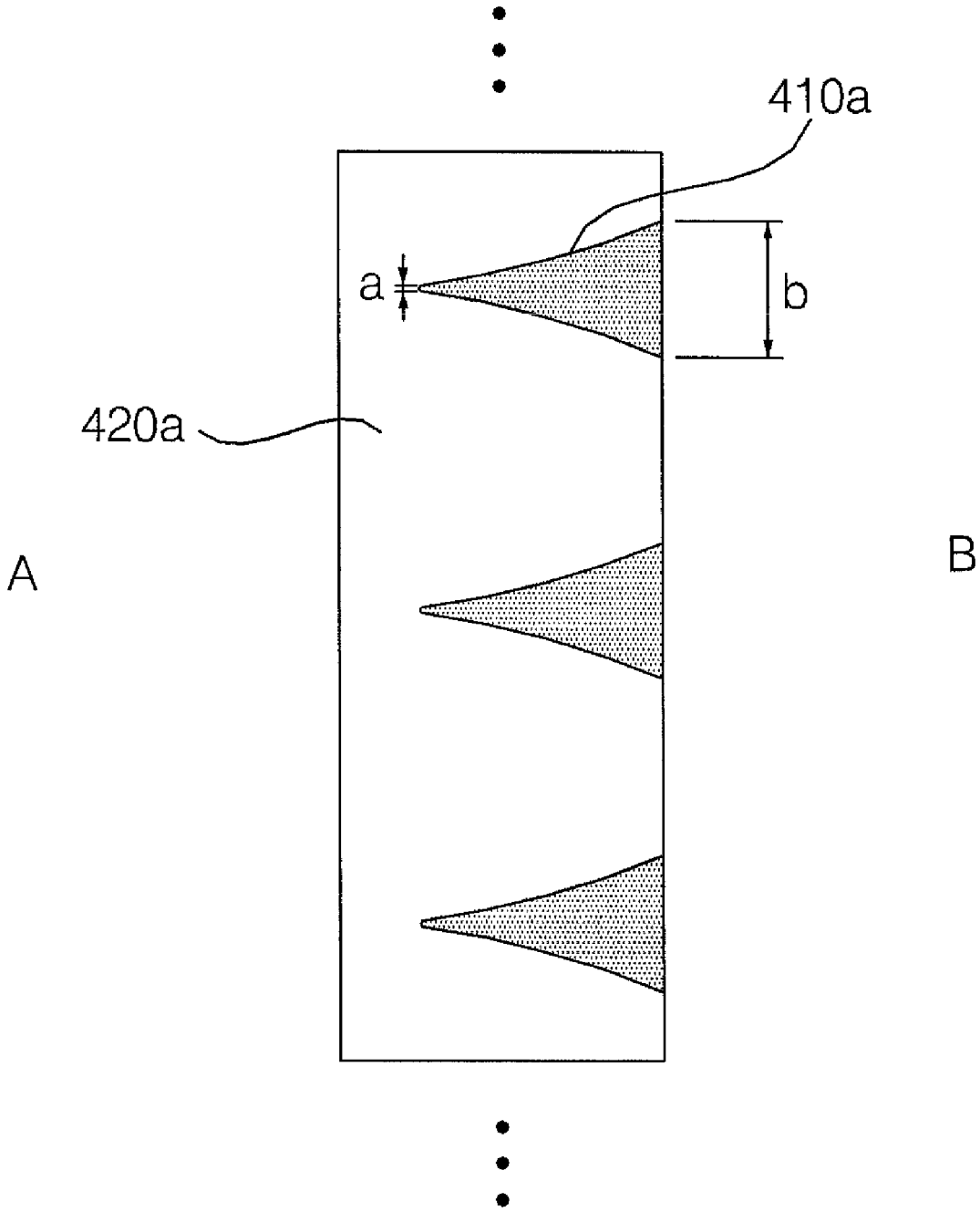
Figure 9B:
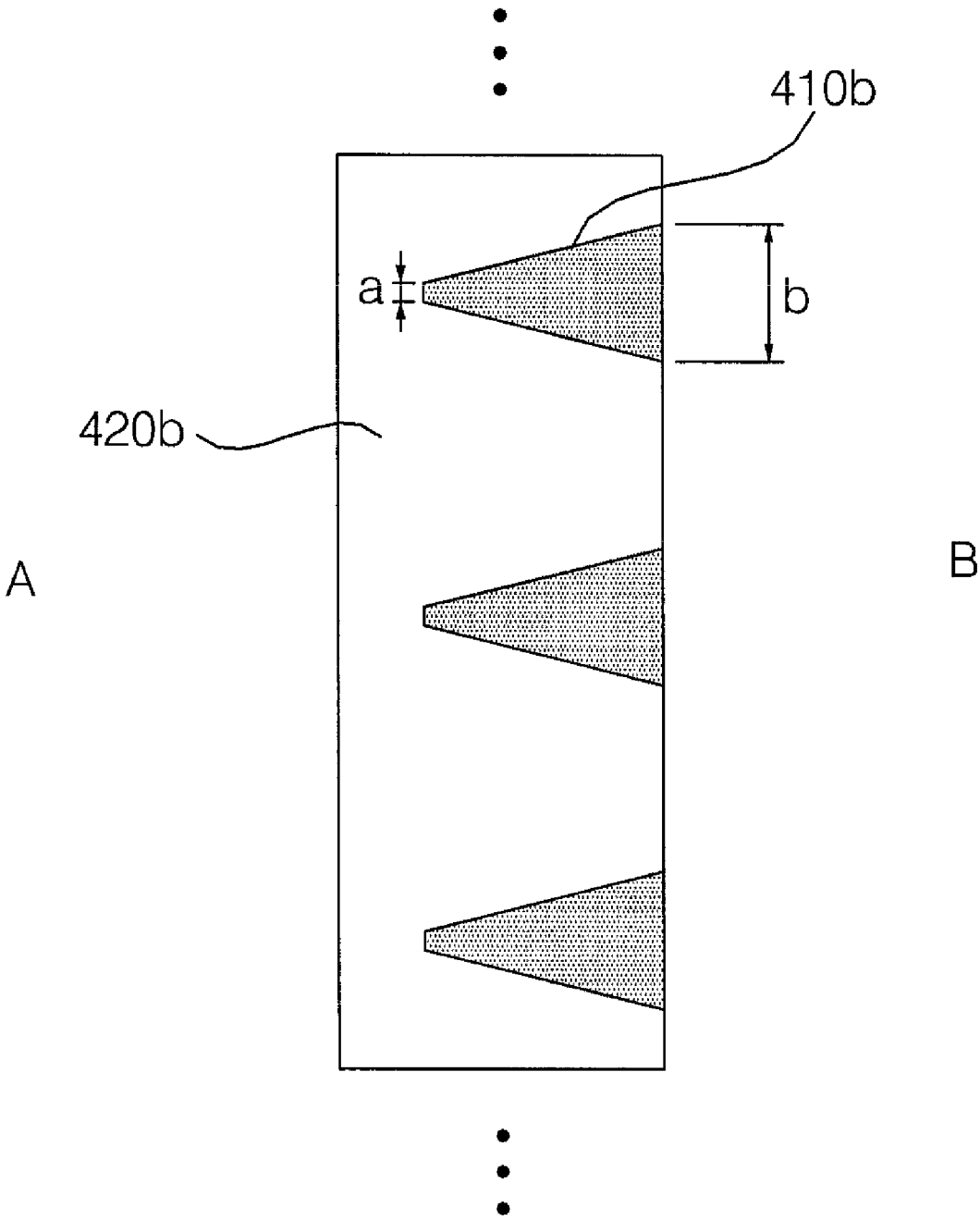
Figure 9C:
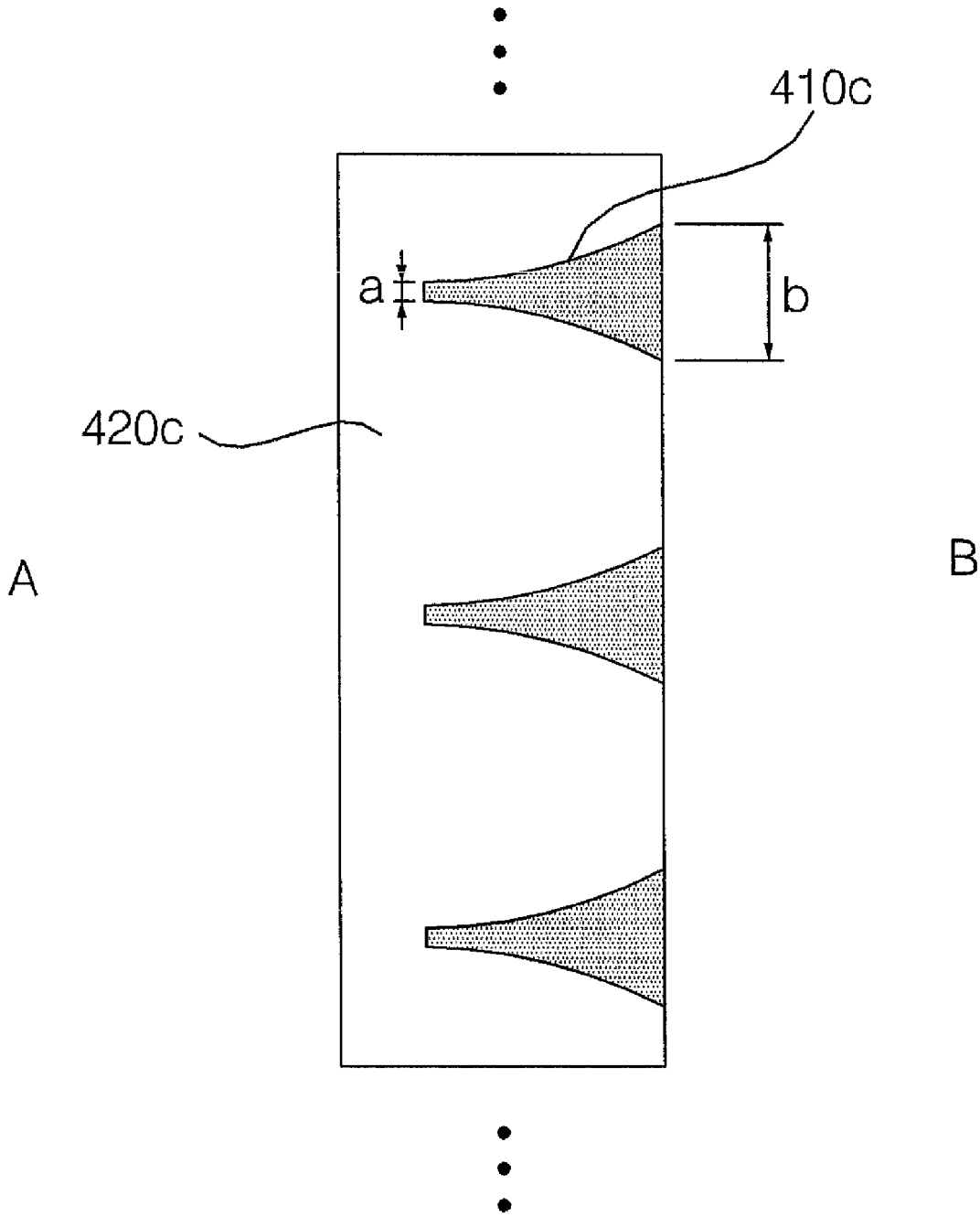
Figure 9C:
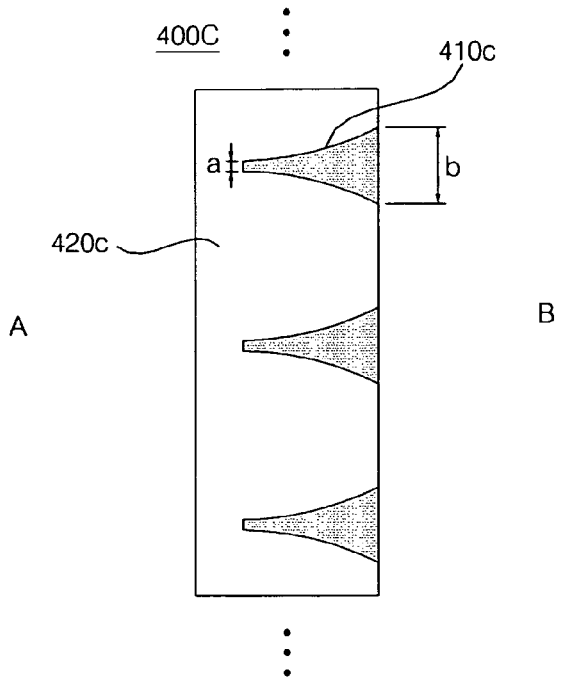

FIG. 9*a* to FIG. 9*c* shows embodiments of the pattern portion of the external light block sheet according to the invention.

As described in the above, it is most preferable that that the cross-sectional shape of the pattern portion included in the external light blocking sheet according to the invention forms an isosceles triangle. However, other available shapes will be illustrated with reference to FIG. 9*a* to FIG. 9*c*. The pattern portion 410*a*, 410*b*, 410*c* is formed with the material which is dark than the base portion 420*a*, 420*b*, 420*c* to have a light absorption function. In that case, the light injected from the outside is effectively blocked and absorbed into the pattern portion. Further, in order to increase the light absorption function of the pattern portion, the light absorption material can be added. The index of refraction of the material forming the pattern portion 410*a*, 410*b*, 410*c* is smaller than the index of refraction of the material forming the base portion 420*a*, 420*b*, 420*c*. The total reflection of the light emitted from the panel is occurred in the interface of the base portion 420*a*, 420*b*, 420*c* and the pattern portion 410*a*, 410*b*, 410*c* so that the light is efficiently emitted to the user side A, while the light which is injected from the outside is blocked not to be injected to the inside of the panel.

In this way, the light which is injected from the outside A is refracted to be blocked by the pattern portion 410*a*, 410*b*, 410*c*. As to the light which is injected from the panel side B, for an effective transmitting, it is most preferable that the lower part b of the pattern portion 410*a*, 410*b*, 410*c* is made to be broader than the upper part a. Accordingly, it is preferable that the width of the upper part a of the pattern portion 120*a* is formed with 5 μm or less, while the lower part b of the pattern portion 120*a* can range from 10 μm to 50 μm. It is most preferable that the width of the upper part a of the pattern portion is formed with 0.1 μm, while the lower part b of the pattern portion is formed with the range of 18 μm to 35 μm in order to maximize the external light blocking function to innovatively improve the bright room contrast of PDP.

Further, the shape of the pattern portion can be variously formed according to the width of the upper part a, the width of the lower part b and the form of an incline. Firstly, as shown in FIGS. 9*a* and 9*c*, the incline of pattern portion 410*a*, 410*c* can be molded into a curve. As shown in FIGS. 9*b* and 9*c*, the width of the upper part a of pattern portion 410*b*, 410*c* can be formed to be broad.

Figure 10A:
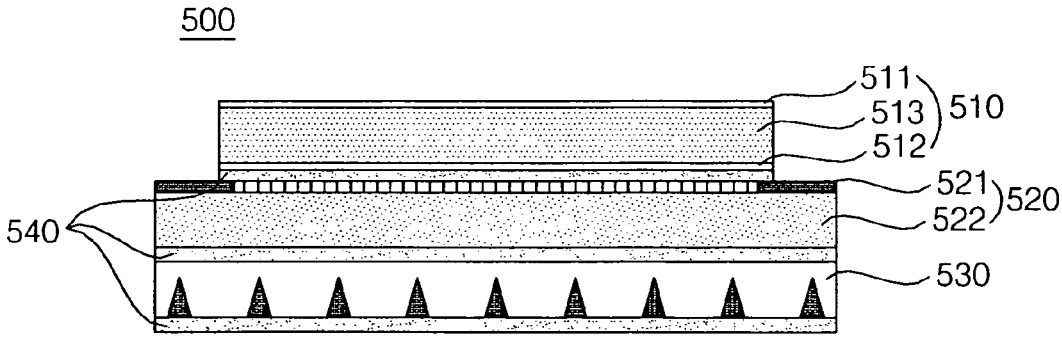
FIG. 10*a* to FIG. 10*d* shows the section view of embodiments of the lamination structure of a filter according to the invention.
Figure 10B:
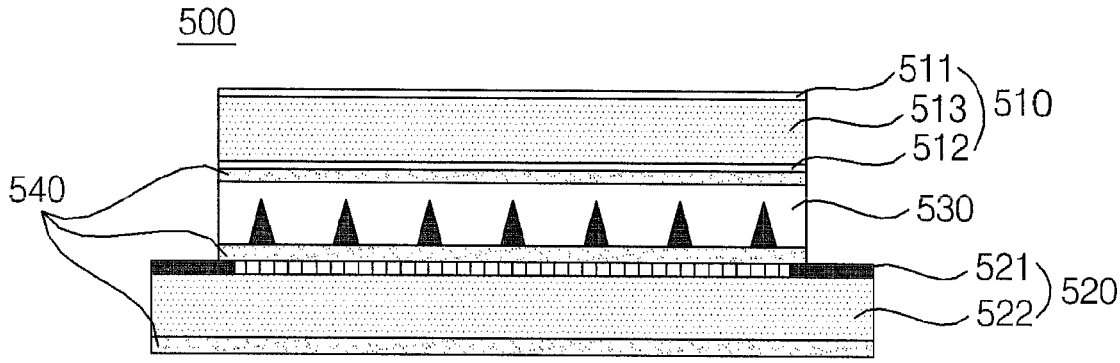

FIG. 10*a* to FIG. 10*b* shows the section view of embodiments of the lamination structure of a external light blocking sheet according to the invention.

Referring to FIG. 10*a*, the external light blocking sheet 500 of the invention comprises an AR/NIR sheet 510, an EMI shielding sheet 520, and an external light blocking layer 530.

As to the AR/NIR sheet 510, the Anti-Reflection AR layer 511 which prevents the reflection of the light injected from the outside to reduce a glare phenomenon is adhered to the front of the base sheet 513 consisting of the transparent plastic material. The Near Infrared NIR shielding layer 512 which shields a near infrared ray radiated from the panel infrared ray to normally deliver signals which are delivered with remote controller is adhered to the rear of the base sheet 513.

As to the EMI shield sheet 520, the EMI shielding layer 521 which shields the Electromagnetic Interference EMI to prevent the EMI radiated from the panel from emitting to the outside is adhered to the front of the base sheet 522 made of a transparent plastic material. At this time, by using the material having a conductivity, the EMI shielding layer 521 is formed with a mesh structure. The conductive material is entirely coated onto a non-effective display region in which an image is not displayed to smoothly realize a ground.

In a room or outdoors, in general, in much cases, the external light source exists over the head of a user. Hence, the external light blocking layer 530 which effectively blocks the external light to express the black image of PDP more darkly is provided.

The adhesive 540 forms a layer between the AR/NIR sheet 510, the EMI shield sheet 520, and the external light blocking layer 530. The adhesive 540 be adamantly adhered to each sheets and the front of PDP. Further, it is preferable that the material of the base sheet included between each sheet is used with a material which is substantially identical in consideration of the simplicity of the external light blocking sheet manufacture.

In the meantime, in FIG. 10*a*, the AR/NIR sheet 510, the EMI shield sheet 520, and the external light blocking layer 530 are laminated in sequence. However, as shown in FIG. 10*b*, the AR/NIR sheet 510, the external light blocking layer 530, and the EMI shield sheet 520 can be laminated in sequence. That is, the lamination sequence of each sheet will be able to be differently controlled by the person skilled in the art. Furthermore, at least one layer of the sheets can be omitted.

Figure 10C:
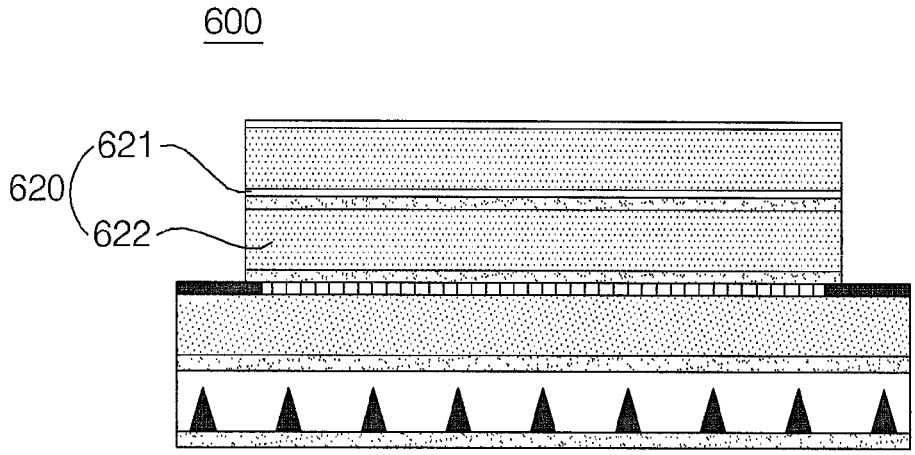
Figure 10D:
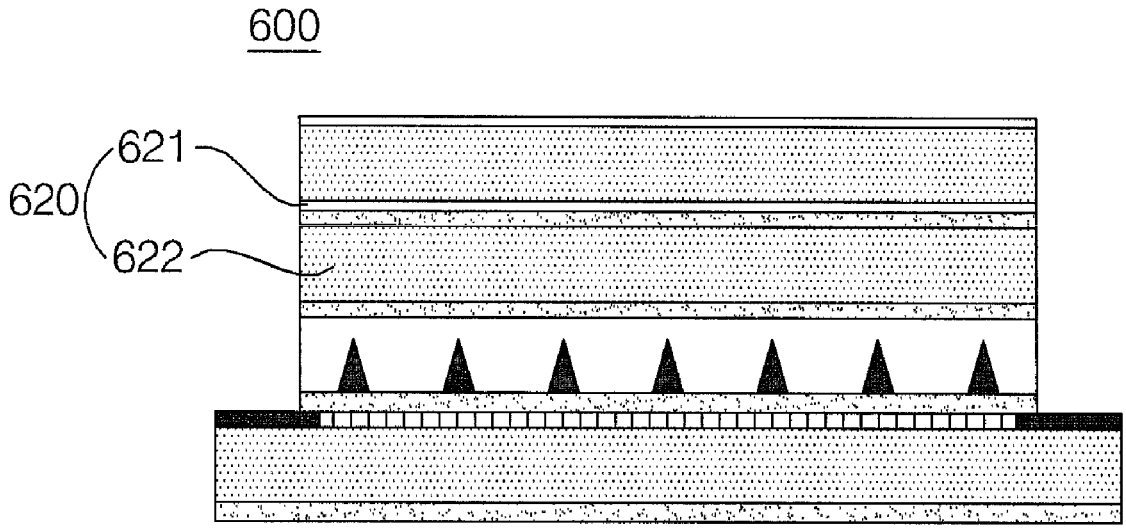

Further, as shown in FIG. 10*c* to FIG. 10*d*, the external light blocking sheet 600 can be comprised of a light characteristic sheet 620 which improves the color temperature of the light injected from the panel and the luminance characteristic. At this time, as to the light characteristic sheet 620, a light characteristic layer 621 consisting of a predetermined dye and an adhesive is laminated on the backplane or the front of a base sheet 622 consisting of a transparent plastic material.

In the meantime, at least one base sheet among base sheets which are included in each sheet shown in FIG. 10*a* to FIG. 10*d* can be omitted, while the function of protecting the panel can be improved by using an adamant glass not a plastic material.

Figure 11:
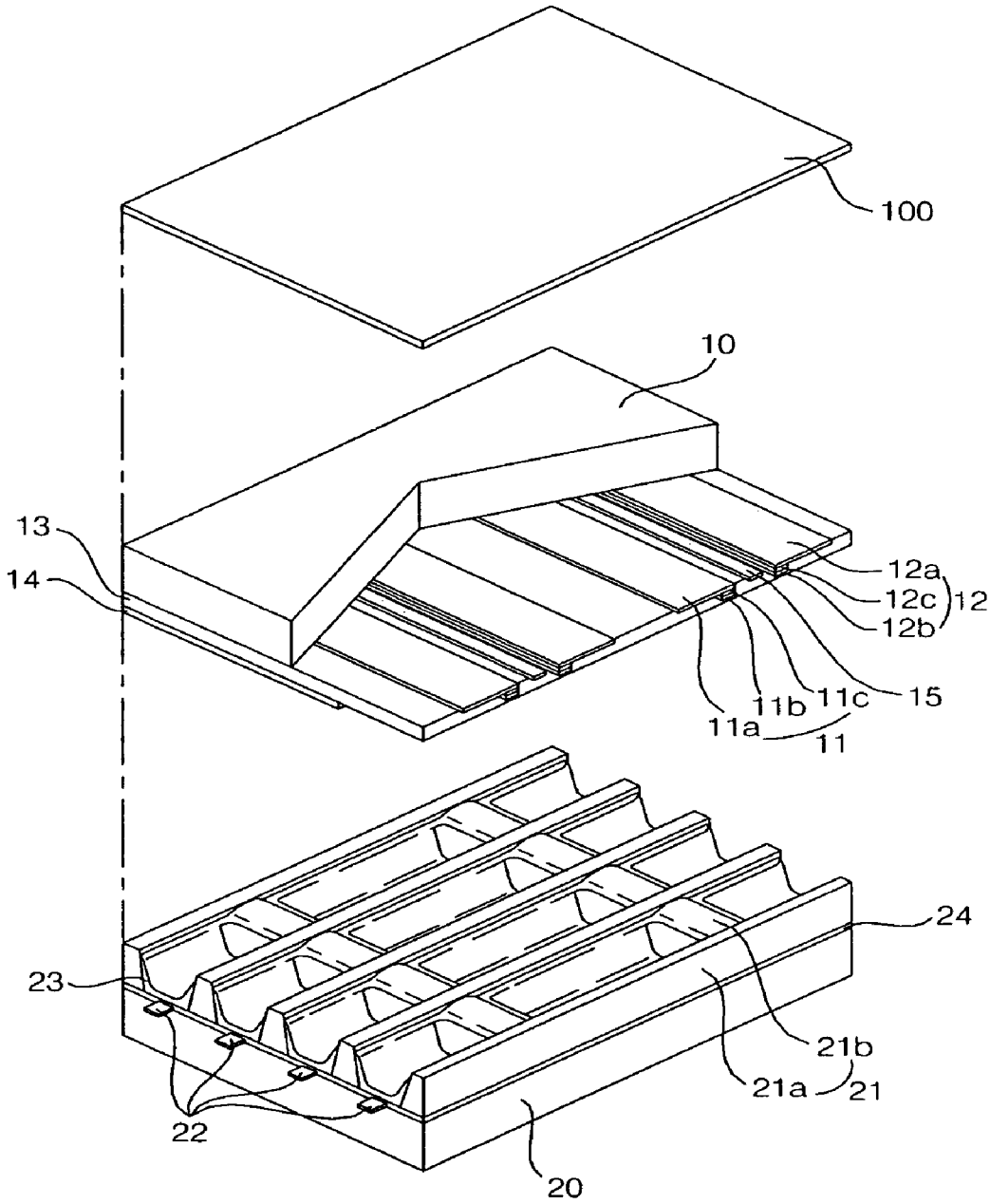
FIG. 11 is a drawing which shows an embodiment of the configuration of a plasma display apparatus according to the invention.

FIG. 11 is a drawing which shows an embodiment of the configuration of a plasma display apparatus according to the invention.

Referring to FIG. 11, it is preferable that a filter 100 is formed in the front of the plasma display panel according to the invention. The filter may be an external light blocking sheet, an Anti-Reflection AR sheet, a Near Infrared NIR shield sheet, an Electro Magnetic Interference EMI shield sheet, a light characteristic sheet.

An adhesive having the thickness that ranges from 10 μm to 30 μm forms a layer between the filter 100 and the panel so that a sticking can be facilitated and the adhesive property can be enhanced. Further, in order to protect the panel from the external pressure, an adhesion layer can be formed between the filter 100 and the panel with the thickness of 30 μm to 120 μm.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display apparatus, comprising:

a plasma display panel; and a filter formed on a front of the plasma display panel, wherein the filter includes an external light blocking sheet that is formed of a base portion and a plurality of pattern portions formed in the base portion, wherein the plurality of pattern portions include an upper portion and a bottom portion that is greater than the upper portion, wherein a first gap between the adjacent pattern portions formed in a first region of the external light blocking sheet is different from a second gap between the adjacent pattern portions formed in a second region of the external light blocking sheet, and wherein the first gap is a shortest distance between the bottom portions of the adjacent pattern portions and the second gap is a shortest distance between the bottom portions of the adjacent pattern portions.

2. The plasma display apparatus of claim 1, wherein a width of the pattern portion formed in the first region is different from a width of the pattern portion formed in the second region.

3. The plasma display apparatus of claim 2, wherein the width of the pattern portion formed in the first region is larger than the width of the pattern portion formed in the second region.

4. The plasma display apparatus of claim 2, wherein the width of the pattern portion formed in the first region is 1.5 times to 4 times greater than the width of the pattern portion formed in the second region.

5. The plasma display apparatus of claim 1, wherein the first gap is smaller than the second gap.

6. The plasma display apparatus of claim 5, wherein the first gap is 0.70 times to 0.99 times of the second gap.

7. The plasma display apparatus of claim 1, wherein the first region is arranged in an area positioned at a center when the front of the external light blocking sheet is divided into three parts, and the second region is arranged in an area positioned at an edge when the front of the external light blocking sheet is divided into three parts.

8. The plasma display apparatus of claim 1, further comprising at least one of an AR layer preventing reflection of the external light, a NIR shielding layer blocking a near infrared ray radiated from the plasma display panel, and an EMI shielding layer blocking an electromagnetic wave.

9. The plasma display apparatus of claim 1, wherein in a cross-sectional shape of the pattern portion, a width of a lower part is wider than a width of the upper part, wherein the lower part of the pattern portion is arranged into the panel side while the upper part of the pattern portion is arranged into the side to which the external light is injected.

10. The plasma display apparatus of claim 1, wherein a thickness of the external light blocking sheet ranges from 1.01 times to 2.25 times greater than a height of the pattern portion.

11. The plasma display apparatus of claim 1, wherein an index of refraction of the pattern portion is smaller than an index of refraction of the base portion.

12. A plasma display apparatus, comprising:

a plasma display panel; and a filter formed on a front of the plasma display panel, wherein the filter includes an external light blocking sheet that is formed of a base portion and a plurality of pattern portions formed in the base portion, wherein the plurality of pattern portions include an upper portion and a bottom portion that is greater than the upper portion, wherein a width of the bottom portion formed in a first region of the external light blocking sheet is different from a width of the bottom portion formed in a second region of the external light blocking sheet.

13. The plasma display apparatus of claim 12, wherein a thickness of the external light blocking sheet ranges from 1.01 times to 2.25 times greater than a height of the pattern portion.

14. The plasma display apparatus of claim 12, wherein a gap from a center of the pattern portion formed in the first region to a center of the adjacent pattern portion is substantially identical with a gap from a center of the pattern portion formed in the second region to a center of the adjacent pattern portion.

15. The plasma display apparatus of claim 13, wherein the width of the pattern portion formed in the first region is 1.5 times to 4 times greater than the width of the pattern portion formed in the second region.

16. The plasma display apparatus of claim 12, wherein the first region is arranged in an area positioned at a center when a front of the external light blocking sheet is divided into three parts, and the second region is arranged in an area positioned at an edge when the front of the external light blocking sheet is divided into three parts.

17. The plasma display apparatus of claim 12, further comprising at least one of an AR layer preventing reflection of external light, a NIR shielding layer blocking a near infrared ray radiated from the plasma display panel and an EMI shielding layer blocking an electromagnetic wave.

* * * * *